US007350547B2

(12) United States Patent
Quiring

(10) Patent No.: US 7,350,547 B2
(45) Date of Patent: Apr. 1, 2008

(54) REFUSE BAG TENSIONER AND METHOD OF USE

(76) Inventor: Frank K. Quiring, 1456 Elsmere, Windsor, Ontario (CA) N8X 4G9

( * ) Notice: Subject to any disclaimer, the term of this patent is extended or adjusted under 35 U.S.C. 154(b) by 0 days.

(21) Appl. No.: 11/322,410

(22) Filed: Jan. 3, 2006

(65) Prior Publication Data

US 2006/0231158 A1 Oct. 19, 2006

Related U.S. Application Data

(60) Provisional application No. 60/672,483, filed on Apr. 19, 2005.

(51) Int. Cl.
*B65B 1/04* (2006.01)

(52) U.S. Cl. ..... 141/391; 141/316; 248/99; 248/100

(58) Field of Classification Search ..... 141/10, 141/114, 313–317, 390, 391; 248/95–101
See application file for complete search history.

(56) References Cited

U.S. PATENT DOCUMENTS 1,669,744 A * 5/1928 Leth-Espensen ..... 294/1.1
2,903,033 A * 9/1959 Robinson ..... 190/122
3,627,243 A * 12/1971 Farrelli ..... 248/99
4,273,167 A * 6/1981 Stillwell ..... 141/314
4,815,866 A * 3/1989 Martone ..... 383/34.1
5,082,219 A * 1/1992 Blair ..... 248/99
6,030,010 A * 2/2000 Graeff ..... 294/1.1
6,202,709 B1 * 3/2001 Wymer ..... 141/10
6,494,619 B1 * 12/2002 Sulpizio ..... 383/33

* cited by examiner

*Primary Examiner*—Steven O. Douglas
(74) *Attorney, Agent, or Firm*—Daryl W. Schnurr

(57) ABSTRACT

A tensioner and method for use in holding the mouth of a bag in an open position has an annular body made of flexible and resilient material with a perimeter of fixed length. The tensioner can be compressed by manually forcing a periphery of the annular body inward. In the compressed position, the annular body is inserted into the mouth of the bag and the inward pressure is removed to allow the annular body to expand against the sides of the bag with sufficient pressure to hold the bag open and to hold the annular body in the installed position within the bag. A tensioner and bag in combination is also described.

11 Claims, 8 Drawing Sheets

REFUSE BAG TENSIONER AND METHOD OF USE

Priority is claimed based upon U.S. Provisional Application Ser. No. 60/672,483 filed on Apr. 19, 2005.

BACKGROUND OF THE INVENTION

1. Field of Invention

This invention relates to a tensioner for holding a mouth of a bag in an open position and, more particularly, to a tensioner that is compressible to fit within a bag and expandable to hold the mouth of the bag in an open position while the bag is being filled.

2. Description of the Prior Art

There, are numerous devices that are designed to hold the mouth of a bag in an open position. In Borland et al U.S. Pat. No. 4,775,123, a device for holding the mouth of a thin flexible bag open has a greater circumferential dimension at the top than at the bottom and has latching arrangements to hold the bag on the device. In the Taylor U.S. Pat. No. 4,805,858, a frame is provided to hold refuse bags in an open position where the bag is wrapped around the frame and held in place by a cord extending around the frame in a channel. The Baldonado et al U.S. Pat. No. 6,003,820 describes a plastic bag holding assembly that fits partially within an opening of a bag. A C-shaped resilient bag holding member is attached to a channel. The bag is placed on the ground and the channel is placed partially within the opening of the bag.

The Nelson et al U.S. Pat. No. 4,832,291 describes a hoop that has a variable peripheral dimension. The dimension is varied by attaching a curved portion of the loop to different locations. The Cheng U.S. Pat. No. 4,759,519 describes a frame apparatus which has clips for attaching the frame to a garbage bag. Two sides of the frame are extendable by sliding one tube within another tube with openings to adjust the length of,the two tubes. The Corsaut, III et al U.S. Pat. No. 4,664,348 describes a bag holder with a straight portion and two flexible plastic strips with notches to attach the bag to the holder. The intermediate portion can be attached to a wall or the device can be used on a floor or the ground. The previous devices have attachment means to attach the bag to the holding device, or the holding device does not work properly or is complex to use or too expensive.

In U.S. Patent Application Publication No. 2005/0023417 by Burns et al, there is described a device for holding a refuse bag open. The device has two ends that can fit together in an adjustable arrangement whereby the peripheral dimension of the device can be varied. The holding device is designed to be used with bags of various different sizes by adjusting the relative location of the two ends and thereby adjusting the circumference of the device. The holding device has female mating elements on one end and male mating elements on the other end and is described as being substantially planar. One of the difficulties in using the device is to affix the ends together with an appropriate circumference so that the device is small enough to fit within the bag, yet large enough to hold the bag open. The device can be placed within the bag and the attachment of the ends can then be adjusted while the device is in the bag. The holding device appears to be very heavy as there is concern about the device tipping the bag over. The holding device can be complex and difficult to use. Further, when the fasteners or the holding device become worm, or pressure is exerted on the holding device, the length of the device might adjust prematurely and the holder might fall to the bottom of the bag or become unusable.

SUMMARY OF THE INVENTION

It is an object of the present invention to provide a tensioner to maintain the mouth of a bag in an open position where the tensioner is one piece of material that can be compressed to insert it into the bag and then released to expand against the sides of the bag to hold the tensioner in position by pressure exerted by the tensioner on the bag. It is a further object to provide a tensioner that is tapered, thereby increasing the resiliency.

It is an object of the present invention to use the tensioner, not only in environmentally friendly paper bags that are used to collect and store yard waste, but also in plastic bags such as garbage bags can also be used with the tensioner.

A tensioner is used for holding a mouth of a bag in an open position, the bag having sides surrounding the mouth. The tensioner comprises an annular body made of flexible and resilient material. The tensioner has a perimeter, a length of the perimeter being unadjustable. The tensioner has a relaxed position and a compressed position. In the compressed position, the tensioner has a reduced area within the perimeter compared to an area when the tensioner is in the relaxed position. The tensioner is changeable from the relaxed position to the compressed position when subjected to sufficient manual force to bend the perimeter inward. The tensioner returns to the relaxed position when the force is removed enabling the tensioner to be sufficiently compressed to be placed in the bag substantially perpendicular to a longitudinal axis of the bag through the mouth and subsequently released to exert outward pressure on the sides of the bag. The pressure is sufficient to hold the tensioner in position relative to the side to hold the mouth in the open position.

A method of holding a mouth of a bag open uses a tensioner, the tensioner having an annular body made from flexible and resilient material. The body has a perimeter and a length of the perimeter is unadjustable. The method comprises choosing a tensioner of an appropriate size for the bag with which the tensioner is to be used, opening the bag and manually forcing the perimeter of the tensioner inward so that the tensioner will fit within the bag in a plane substantially perpendicular to a longitudinal axis through the mouth, locating the tensioner near the mouth and releasing the tensioner to allow the tensioner to return toward a relaxed position until the perimeter abuts an inside of the sides of the bag with sufficient pressure that the tensioner remains substantially in position within the bag, filling the bag with desired contents and removing the tensioner from the bag.

BRIEF DESCRIPTION OF THE DRAWINGS

FIG. 8 is a schematic sectional side view of the tensioner of FIG. 7 flipped upside down and the bag pulled through.

DETAILED DESCRIPTION OF A PREFERRED EMBODIMENT

Figure 1:
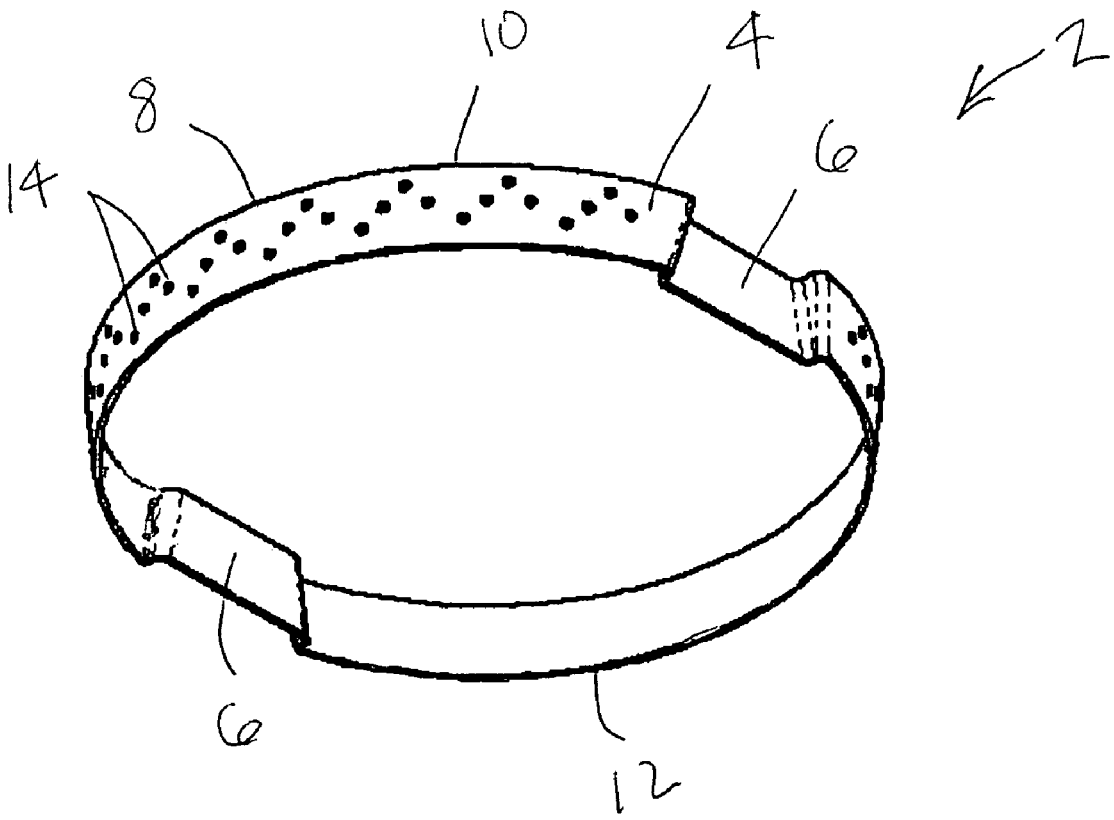
FIG. 1 shows a perspective view of a tensioner having handles thereon.

In FIG. 1, a tensioner 2 has an annular body 4 with handles 6 at either side. While the annular body 4 is round, except for the handles, the annular body can have an oval shape or even a generally rectangular shape with rounded corners. The annular body can also have one or more straight sections (not shown). The annular body has a perimeter 8, a length of the perimeter being unadjustable. It can be seen that the annular body 4 is tapered with an upper edge 10 sloping inward to a lower edge 12. The annular body converges from the upper edge to the lower edge. The perimeter 8 extends along an outer portion the upper edge 10 as the distance along the upper edge is greater than the distance along the lower edge and it is the perimeter that determines whether the tensioner is of an appropriate size for a particular bag. The perimeter 8 is an imaginary line as it extends past the handles 6 to continue the circular path of upper edge 10. There are small black circles 14 on an outer surface of the tensioner 2, the small black circle being nodules or roughened areas of the outer surface. These nodules or roughened areas can be arranged in a particular pattern or they can be located over only the upper part of the outer surface or over the entire outer surface as desired. The purpose of the nodules or roughened areas is to provide more friction between the tensioner and the bag (not shown in FIG. 1).

Figure 2:
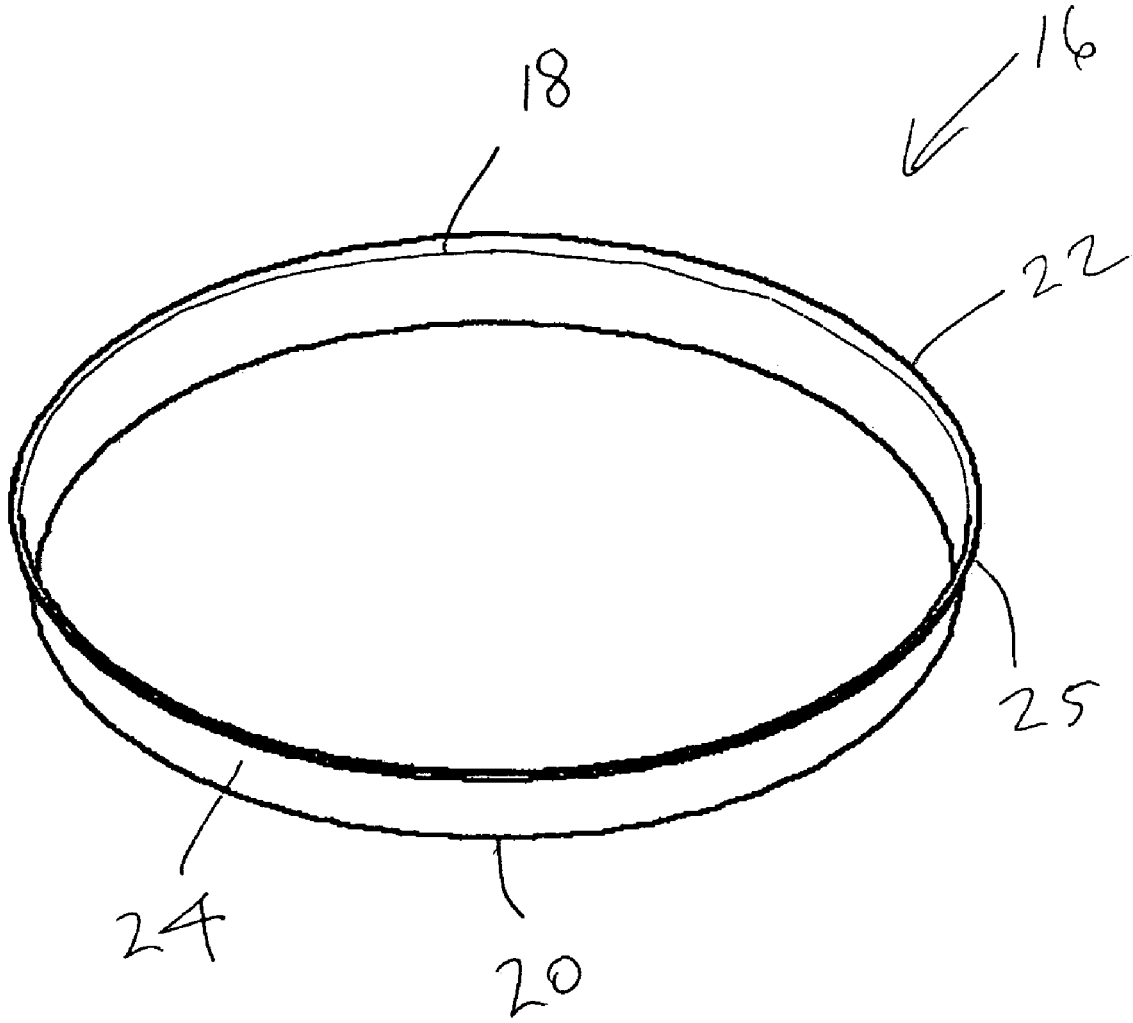
FIG. 2 is a perspective view of a further embodiment of a tensioner without handles.

In FIG. 2, there is shown a further embodiment of a tensioner 16 that is very similar to the tensioner 2, but does not have any handles and does not have nodules or a roughened outer surface. The tensioner 16 has an upper edge 18 and a lower edge 20 with a perimeter 22 being along an outer surface of the upper edge 18. The tensioner 16 has an annular body 24 that is tapered. The tensioner 16 has a bead 25 along the perimeter 22 on an outside of the upper edge 18. The bead provides a location for a line of contact when the tensioner is installed in a bag (not shown in FIG. 2). Even when there is no bead on the edge that is further from the centre, a line of contact will be formed with the bag. The tapered shape and the bead reduces the area of contact with the bag, thereby increasing the pressure along that area of contact. When the tensioner has handles, the handles interrupt the line of contact as the handles as shown in FIG. 1 are indented.

The tapered annular body 4, 24 allows a plurality of tensioners of the same size to be stacked on top of one another, thereby occupying much less space for shipping and in a retail setting. The tapered shape also provides increased resiliency to the tensioner.

Figure 3:
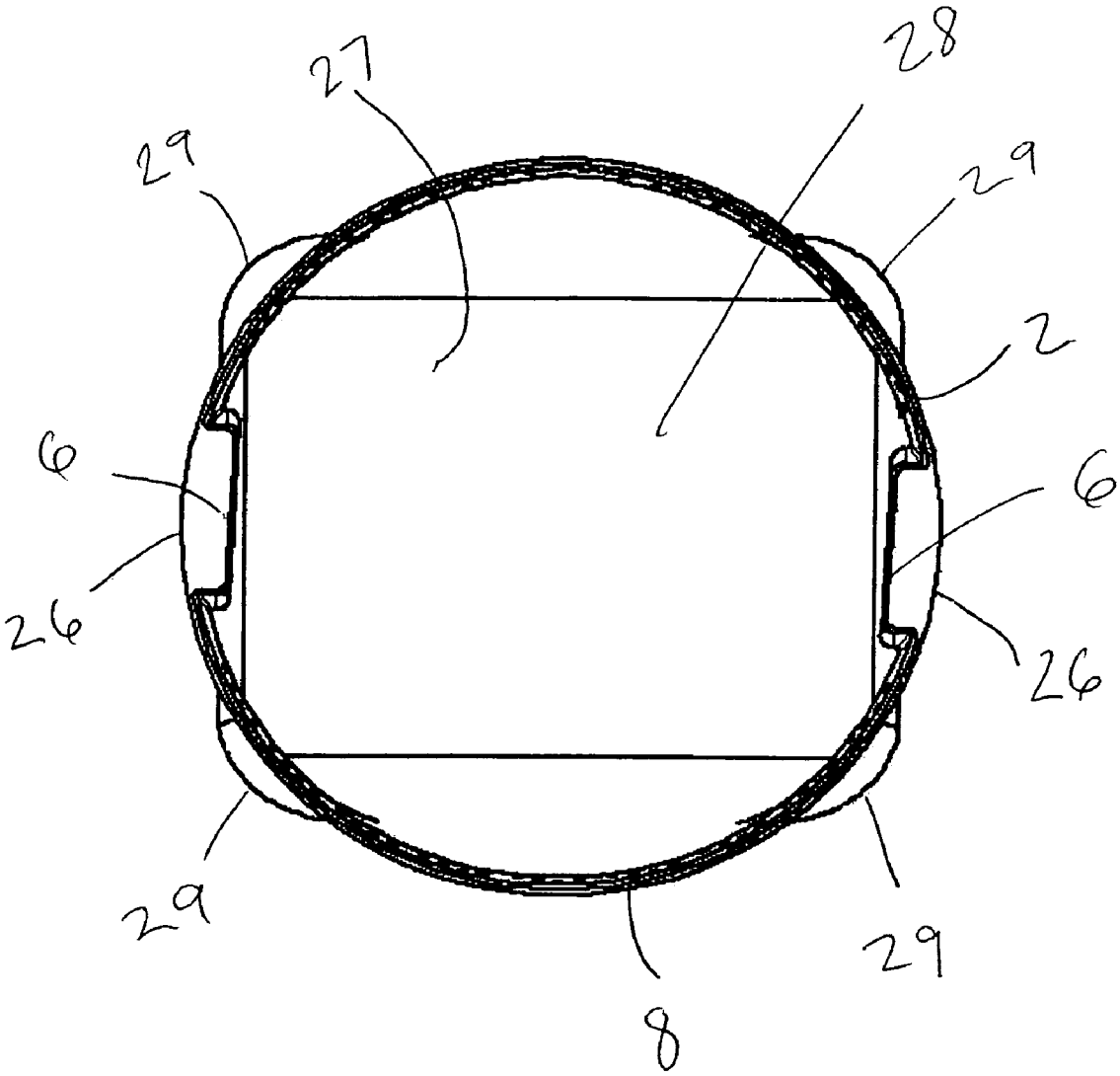
FIG. 3 is a top view of the tensioner of FIG. 1 installed in a bag.

In FIG. 3, there is shown a top schematic view of the tensioner 2 installed in a refuse bag 26. The bag 26 has a rectangular shape with a bottom 27. The same reference numerals are used in FIG. 3 as those used in FIG. 1 to describe those components that are identical. The tensioner 2 shown in FIG. 1 is in a relaxed position, and the tensioner 2 shown in FIG. 3 is almost in the relaxed position but is slightly constrained by the force of the sides of the bag on the perimeter 8 of the tensioner 2 as the circumference of the bag is slightly smaller than the perimeter of the tensioner. The bag 2 has a mouth 28. The bag 26 has four corners 29 that are schematically shown in their position before the tensioner 2 has been inserted into the mouth of the bag. The handles 6 do not contact the bag 26 to exert outside pressure when the tensioner is installed in the bag.

Figure 4:
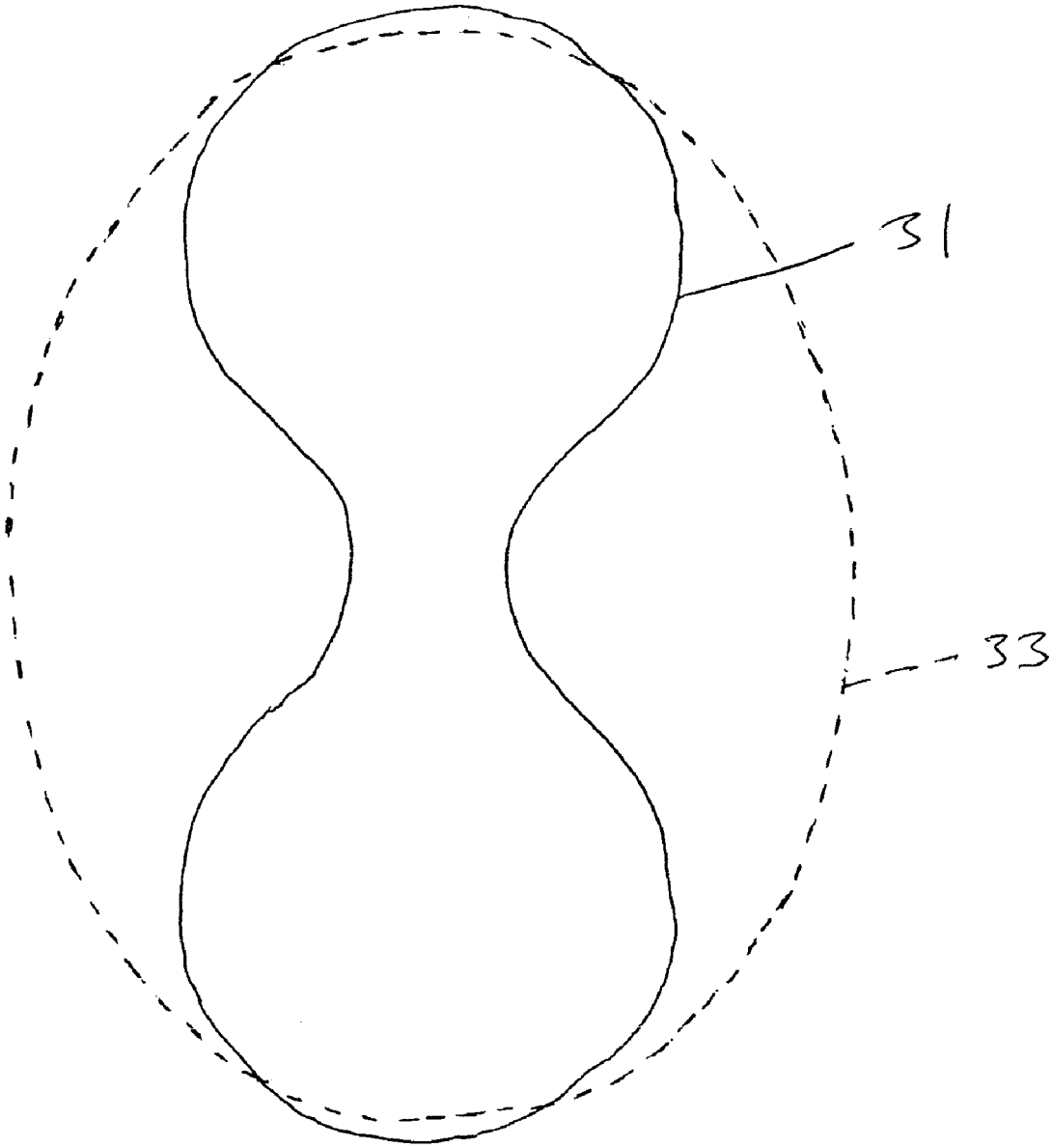
FIG. 4 is a schematic top view of the tensioner in a compressed position.

In FIG. 4, there is shown a schematic top view of the annular tensioner 31 in a compressed position allowing the tensioner 31 to be inserted into the mouth 28 of the bag 26 (not shown in FIG. 4). The tensioner 31 is moved to the compressed position simply by applying an inward manual force to the annular body and preferably applying that force to the handles (not shown in FIG. 4). After insertion into the mouth of the bag, the tensioner is released. The resiliency causes the tensioner to expand until the sides of the bag prevent further expansion. The tensioner can be removed from the bag by compressing it or by pulling the tensioner from the bag. The tensioner 31 is shown in a relaxed position by dotted lines 33.

Figure 5:
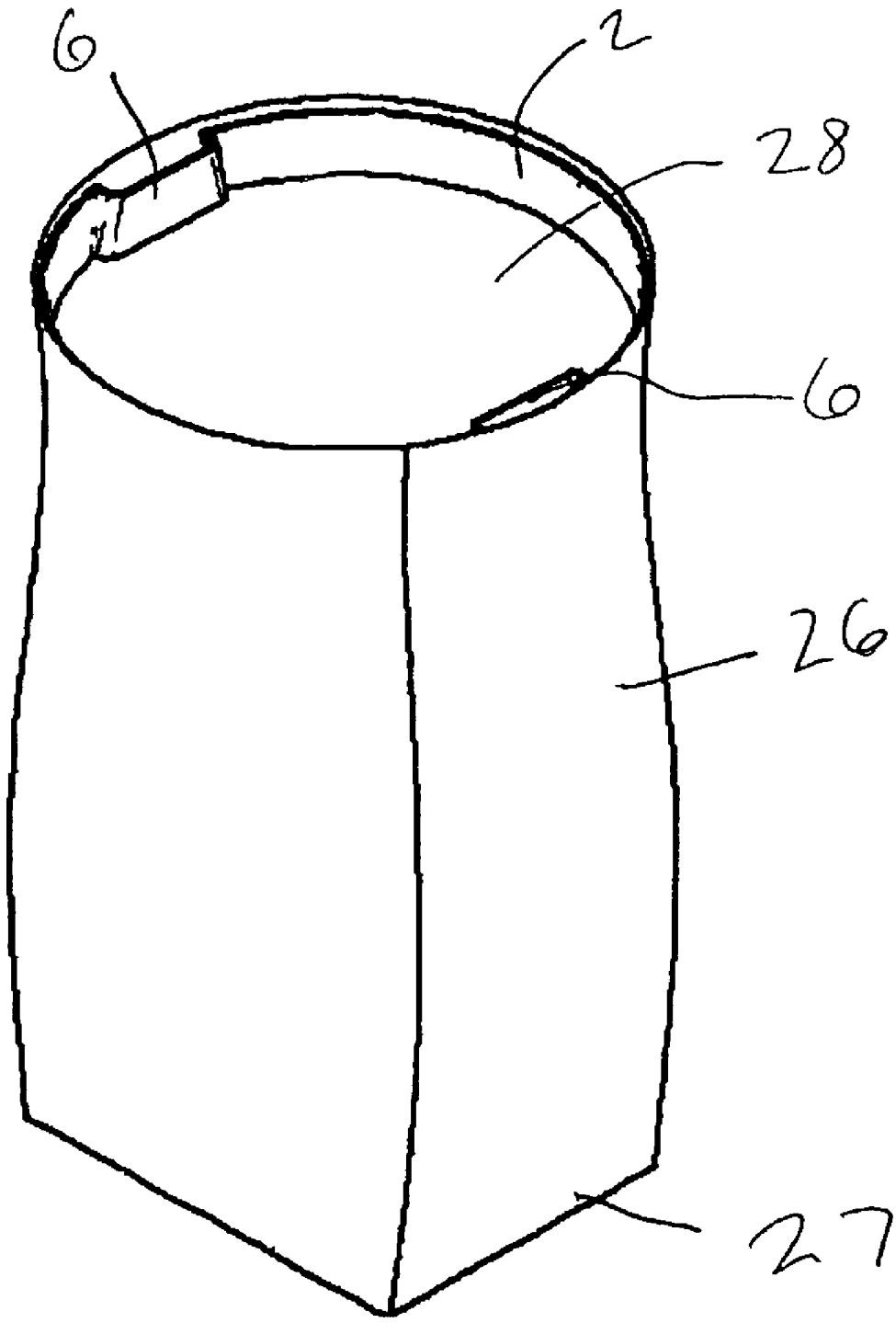
FIG. 5 is a perspective view of the tensioner of FIG. 1 installed at a top of a rectangularly shaped refuse bag.

In FIG. 5, it can be seen that the tensioner 2 is installed near a top of the bag 26. The bag is a typical yard waste or refuse bag that is made of heavy paper and is approved by many municipalities for use in disposing of yard waste, for example, leaves, grass cuttings and other vegetation.

Figure 6:
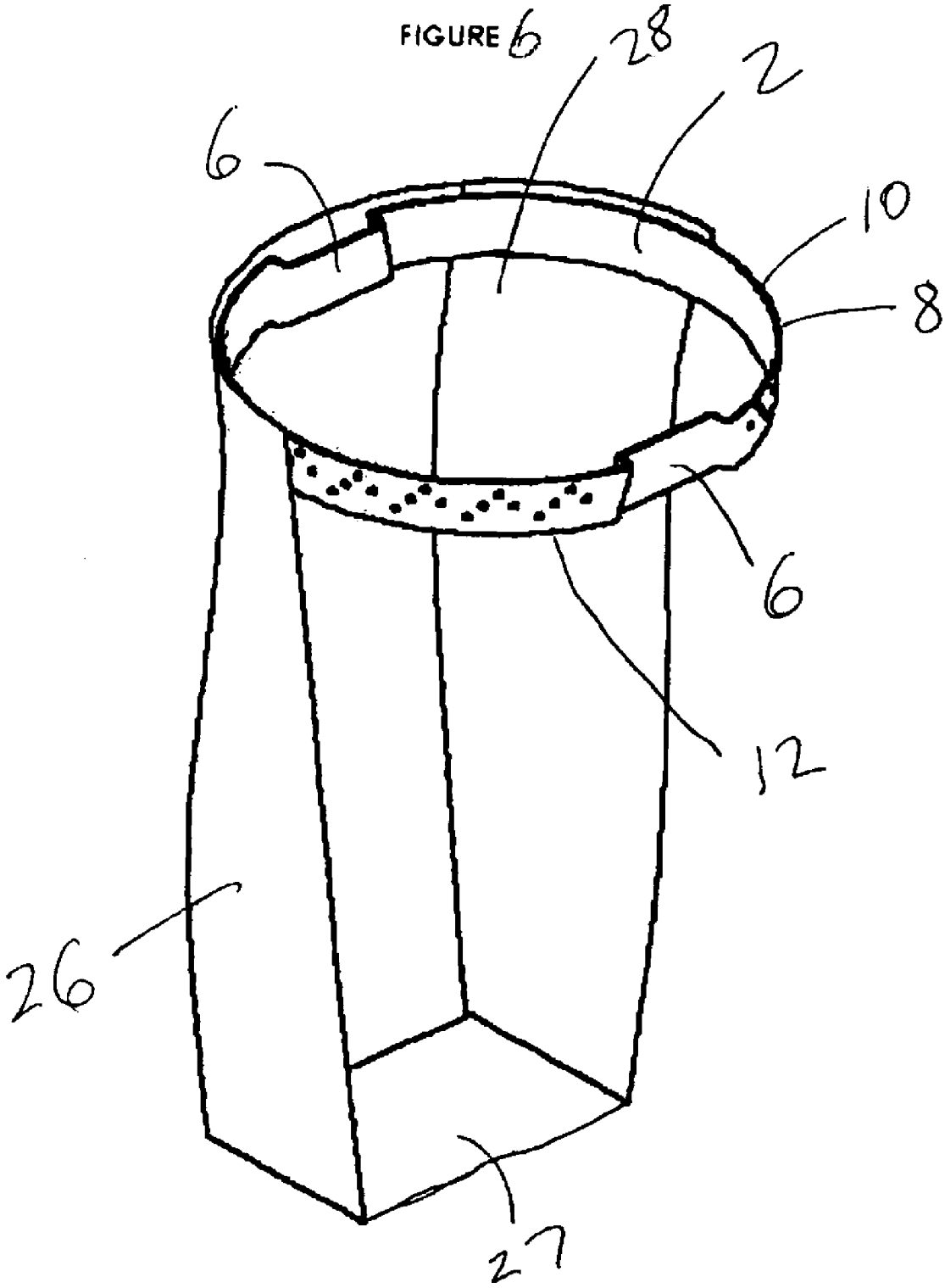
FIG. 6 is a partial perspective view of the tensioner and bag of FIG. 5 with the bag partially cut away to expose more of the tensioner.

In FIG. 6, there is shown a similar view to FIG. 5 except part of the bag 26 has been removed to expose a much larger portion of the tensioner 2. The same reference numerals are used in FIGS. 5 and 6 as those used in FIGS. 1 and 3 for those components that are identical.

Figure 7:
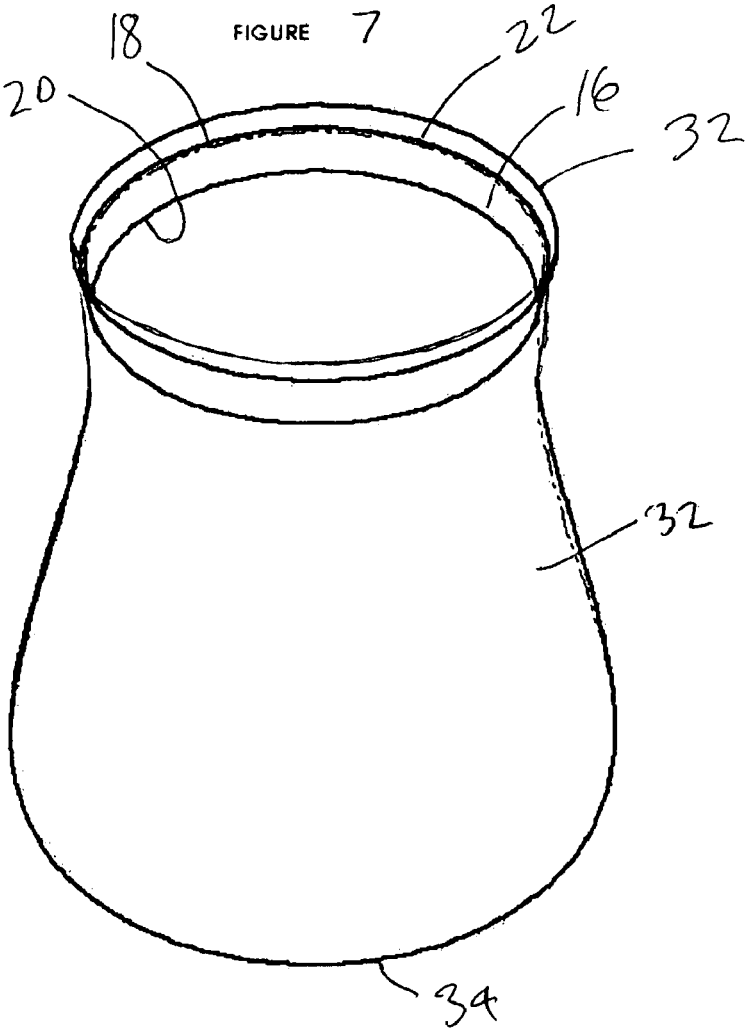
FIG. 7 is a perspective view of the tensioner of FIG. 2 installed in a clear plastic garbage bag.
Figure 8:
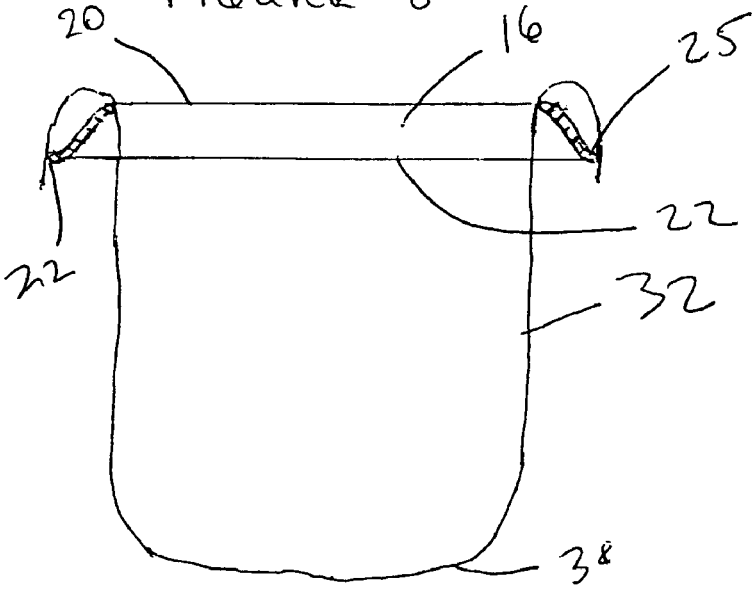

In FIG. 7, there is shown a perspective view of the tensioner 16 installed into a mouth 30 of a transparent plastic bag 32. The tensioner 16 is almost in the relaxed position shown in FIG. 2, but is restrained by the sides of the bag 32. The tensioner 16 is installed in the bag 32 by manually forcing the tensioner 16 to the compressed position (not shown) and inserting it into the mouth 30 of the bag substantially perpendicular to a longitudinal center axis of the bag through said mouth. When the tensioner has been so inserted, a bottom 34 of the bag is manually drawn through the tensioner and the tensioner is flipped upside down as shown in FIG. 8. This arrangement provides a much tighter and more secure attachment of the bag 32 to the tensioner 16. The same reference numerals are used in FIGS. 7 and 8 as used in FIG. 2 to describe those components that are identical While the tensioner 16 is shown as being used with the plastic bag 32, which can be any type of plastic bag, including the common garbage bag, the tensioner 2 can be used in place of the tensioner 16 with garbage bags of an appropriate size. In other words, the tensioner 16 and the tensioner 2 are interchangeable and can be used in the upright positions shown in FIGS. 1 and 2 or can be used in an upside down position. When using the tensioner with a plastic bag and drawing the bag through the tensioner after the tensioner has been installed in the mouth of the bag, one may wish to install the tensioner initially into the bag in the upside down position. Then, when the bag is pulled through and the tensioner is flipped over, the perimeter 22 will be above the lower edge 20. However, the orientations of the tensioner shown in FIGS. 7 and 8 are preferred.

Figure 9:
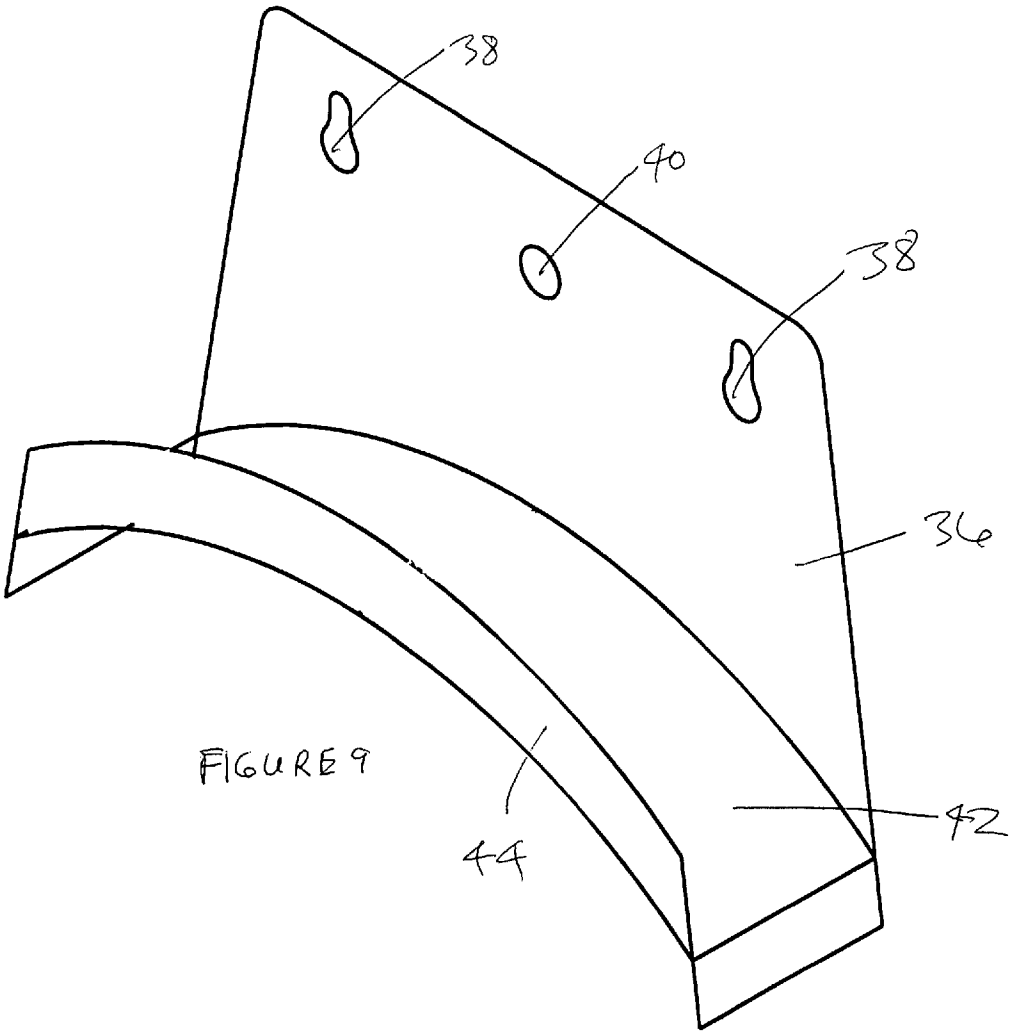
FIG. 9 is a perspective view of a support.

In FIG. 9, there is shown a perspective view of a holder 36 for the tensioner (not shown in FIG. 8). The holder has holes 38, 40 therein for mounting the holder on a wall or other support (not shown). For example, when a tensioner is installed in a plastic garbage bag, the tensioner can be hung on the bag in a garage or other location of a residence. A user can then fill the bag over time and when the bag has been filled, remove the tensioner and install it into a subsequent bag, which can then be hung on the holder on a rounded surface 42. The tensioner (not shown in FIG. 9) is maintained on the surface 42 by a lip 44.

Alternatively, the holder can be mounted on a foldable stand (not shown) with legs that are hinged at a top and spread outward to support the holder and bag. The stand can be placed in the yard with the tensioner installed in a plastic bag and supported by the holder. The bag can then be filled with leaves and the like, removed and replaced with a new bag. The stand can be moved about the yard as desired. The stand is not shown in the drawings. Various holders and stands can be used with the tensioner.

Various types of bags can be used with the tensioner of the present invention. For example refuse bags, yard waste bags, paper bags, plastic bags, and garbage bags can be used with the tensioner. The same tensioner can be used with bags within a certain size range. Different size tensioners must be used with different size bags where there is a difference in size that will cause the tensioner to be much too large or too small to be properly inserted into the bag in a position where pressure is exerted on the sides of the bag to hold a mouth of one bag open.

Preferably, the tensioner has a bead on an extension of an upper surface and a bead on an interior of a lower surface. The tensioner can have any annular shape as long as the shape allows for sufficient flexibility and resiliency.

Annular is defined to include circular, oval, generally rectangular with rounded corners or a combination of these shapes. For example, the annular body can be oval with straight sections at each end or straight sections at each end and the two sides. The straight sections are preferably quite short. Annular includes both tapered and non-tapered shapes, but a tapered annular body is preferred. The annular body must have a perimeter to contact the bag and a large central opening to allow one bag to be filled when the tensioner is installed. The size of the tensioner is chosen so that the perimeter of the tensioner is slightly greater than the circumference of the bag. A user of the tensioner can have one size of tensioner for the paper yard waste bags and another size of tensioner for regular sized plastic garbage bags. The shape of the tensioner for the yard waste bags is preferably oval as the bags are rectangular. The shape of the tensioner for the garbage bags is preferably circular. Circular tensioners will operate well in rectangular or oval shaped bags and vice-versa. When the tensioner has handles, the perimeter of the tensioner is the perimeter that the tensioner would have if the handles were not present. The perimeter is the imaginary outline of the outermost edge of the tensioner that extends outside of the handles to continue the perimeter of the remainder of the tensioner past the handles.

I claim:

1. A tensioner for use in holding a mouth of a bag in an open position, said bag having sides surrounding said mouth, said tensioner comprising an annular body and being made from flexible and resilient material, said body having a first edge and a second edge, said body conveying from said first edge to said second edge, said tensioner having a perimeter, a length of said perimeter being unadjustable, said tensioner having a relaxed position and a compressed position, in said compressed position said tensioner having a reduced area within said perimeter compared to an area when said tensioner is in said relaxed position, said tensioner being changeable from said relaxed position to said compressed position when subjected to sufficient force to bend said perimeter inward, said tensioner returning toward said relaxed position when said force is removed, enabling said tensioner to be sufficiently compressed to be placed in said bag substantially perpendicular to a longitudinal axis of said bag through said mouth, and subsequently released to exert outward pressure on said sides of said bag, said pressure being sufficient to hold said tensioner in position relative to said sides and to hold said mouth in said open position.

2. A tensioner as claimed in claim 1 wherein said tensioner has a periphery that is slightly larger than an inside perimeter of said sides of said bag against which said tensioner is to be installed.

3. A tensioner as claimed in claim 1 wherein said tensioner is a continuous loop and is made from a plastic material that can be bent inward when subjected to an external force without creasing so that said tensioner can return to its original position when said force is removed.

4. A tensioner as claimed in claim 1 wherein said contact surface is uneven to increase friction between said contact surface and said bag.

5. A tensioner as claimed in claim 1 wherein said contact surface is rough.

6. A tensioner as claimed in claim 4 wherein said contact surface has a series of projections thereon to increase friction between said projections and said bag.

7. A tensioner as claimed in claim 1 wherein the annular body has indented portions on opposing sides thereof, said indented portions being handles.

8. A tensioner as claimed in claim 1 wherein said annular body is a shape selected from the group of circular, oval and generally rectangular with rounded corners.

9. A tensioner as claimed in claim 1 wherein said tensioner forms a line of contact with said bag along said first edge.

10. A tensioner as claimed in claim 8 wherein said annular body has a bead extending outward from said first edge.

11. A tensioner and bag in combination comprising a tensioner with an annular body having a perimeter that is slightly longer than a circumference of the bag at a mouth of the bag, said annular body is tapered with one edge further from a centre of said body than an opposing edge, said tensioner being unadjustable in length, flexible and resilient, said tensioner being compressible for insertion into the mouth of the bag and expandable to exert pressure on the sides of the bag when released, the tensioner exerting sufficient pressure on the sides of the bag to hold a mouth of the bag open.

* * * * *